US006278091B1

(12) United States Patent
Van Gooden

(10) Patent No.: US 6,278,091 B1
(45) Date of Patent: Aug. 21, 2001

(54) REMOVABLE CLOTH SLEEVE WITH INCORPORATED HEATING COIL

(76) Inventor: Edwin Van Gooden, 4516 W. 130th St., Hawthorne, CA (US) 90250

( * ) Notice: Subject to any disclaimer, the term of this patent is extended or adjusted under 35 U.S.C. 154(b) by 0 days.

(21) Appl. No.: 09/591,652

(22) Filed: Jun. 10, 2000

Related U.S. Application Data

(63) Continuation-in-part of application No. 09/377,116, filed on Aug. 19, 1999.

(51) Int. Cl.[7] ..... H05B 3/54

(52) U.S. Cl. ..... 219/528; 219/529; 219/545; 219/549; 219/535

(58) Field of Search ..... 219/528, 529, 219/549, 535, 212, 217; 392/339

(56) References Cited

U.S. PATENT DOCUMENTS

| | | | | |
|---|---|---|---|---|
| 3,079,486 | * | 2/1963 | Winchell | 219/528 |
| 5,005,374 | * | 4/1991 | Spitler | 219/528 |
| 5,436,429 | * | 7/1995 | Cline | 219/535 |
| 5,999,699 | * | 12/1999 | Hyatt | 392/339 |

* cited by examiner

*Primary Examiner*—Tu Ba Hoang
(74) *Attorney, Agent, or Firm*—Goldstein Law Offices P.

(57) ABSTRACT

A removable cloth sleeve with incorporated heating coil including a heating element wrappedly engaging a bottle of lotion. The heating element is comprised of an interior heating pad. The interior heating pad has an innermost heating coil. The heating element includes an outer cloth pad for removably receiving the interior heating pad therein. The heating element can be removably coupled with the bottle of lotion.

5 Claims, 2 Drawing Sheets

FIG 1
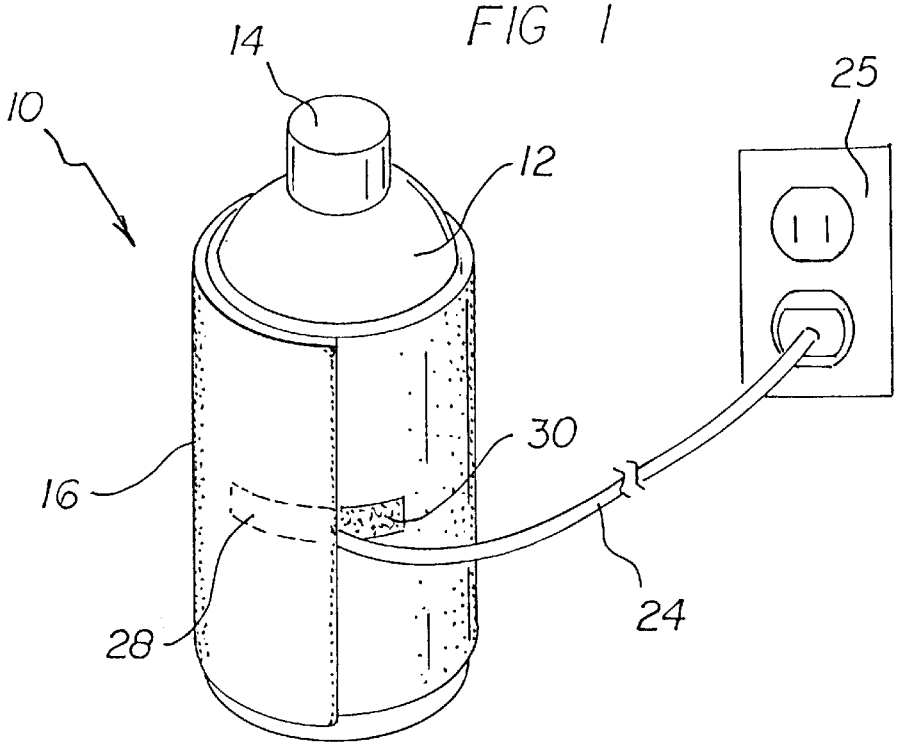
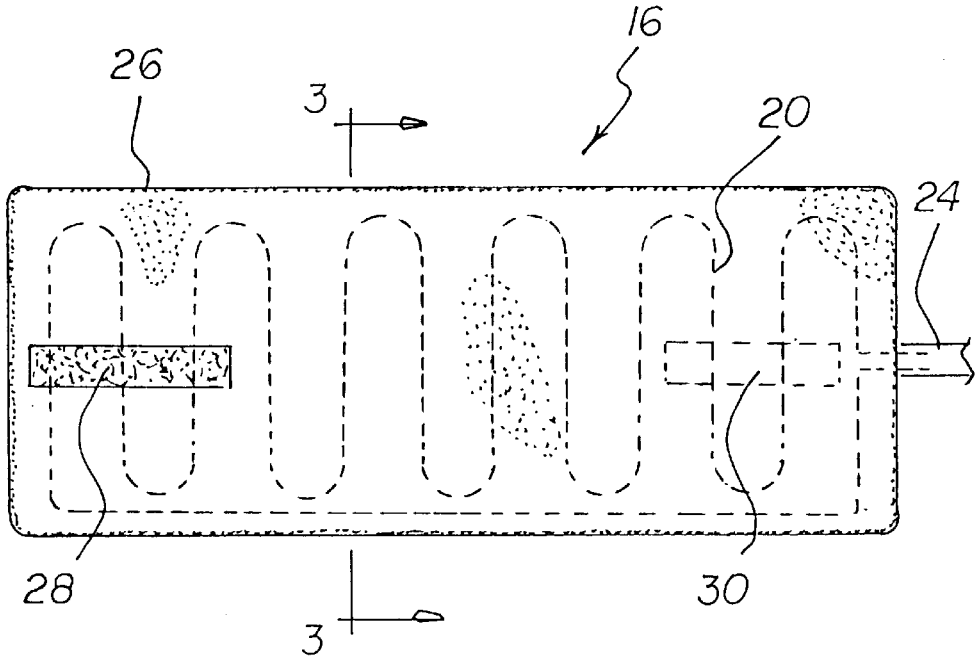
FIG 2

REMOVABLE CLOTH SLEEVE WITH INCORPORATED HEATING COIL

CROSS REFERENCES AND RELATED SUBJECT MATTER

This application is a continuation-in-part of U.S. patent application Ser. No. 09/377,116, filed in the United States Patent and Trademark Office on Aug. 19, 1999.

BACKGROUND OF THE INVENTION

The present invention relates to a removable cloth sleeve with incorporated heating coil and more particularly pertains to allowing any standard lotion bottle to be warmed before application.

People often use all types of lotion, typically for application on their skin. The lotion is used to treat various ailments or, otherwise, is used to treat dry skin. Sometimes, the lotion, during cold winter months cold and people are reluctant to apply it to their skin. Normally room temperature is too cool for some people to enjoy applying the lotion to their body. Thus, there is a need for a way to warm up the lotion so that the application to the body is an enjoyable task.

The present invention attempts to solve the abovementioned problem by utilizing a heating element that can be wrapped around a lotion bottle so that lotion can be warmed to comfortable temperature before applying it to a user's skin.

The use of heating devices is known in the prior art. More specifically, heating devices heretofore devised and utilized for the purpose of heating various items are known to consist basically of familiar, expected and obvious structural configurations, notwithstanding the myriad of designs encompassed by the crowded prior art which have been developed for the fulfillment of countless objectives and requirements.

By way of example, U.S. Pat. Nos. 3,144,174 to Abplanalp and 3,069,528 to Gardner disclose electrical heating means for warming shaving cream; however, they appear to apply the heat to pressure discharge cans. U.S. Pat. No. 5,161,646 to Aurich discloses a heated dispenser.

U.S. Pat. No. 4,065,660 to Berard discloses an electrical appliance for heating feeding bottles. In particular, Berard discloses a device having a stand, and a cloth extending from the stand which may be wound around a feeding bottle. The use of the stand makes the device of Berard quite cumbersome and impractical for the simple task of heating lotion bottles.

While these devices fulfill their respective, particular objective and requirements, the aforementioned patents do not describe a removable cloth sleeve with incorporated heating coil for allowing any standard lotion bottle to be warmed before application.

In this respect, the removable cloth sleeve with incorporated heating coil according to the present invention substantially departs from the conventional concepts and designs of the prior art, and in doing so provides an apparatus primarily developed for the purpose of allowing lotion to be warmed before application.

Therefore, it can be appreciated that there exists a continuing need for new and improved removable cloth sleeve with incorporated heating coil which can be used for allowing any standard lotion bottle to be warmed before application. In this regard, the present invention substantially fulfills this need.

SUMMARY OF THE INVENTION

In the view of the foregoing disadvantages inherent in the known types of heating devices now present in the prior art, the present invention provides an improved removable cloth sleeve with incorporated heating coil. As such, the general purpose of the present invention, which will be described subsequently in greater detail, is to provide a new and improved removable cloth sleeve with incorporated heating coil and method which has all the advantages of the prior art and none of the disadvantages.

To attain this, the present invention essentially comprises a stand-alone heating element adapted for wrappedly engaging a bottle. The heating element is comprised of an interior heating pad. The interior heating pad has an innermost heating coil in a serpentine configuration. The innermost heating pad is disposed within a protective liner. The interior heating pad has a power cord extending directly outwardly therefrom for operatively coupling with an electrical outlet. The heating element includes an outer cloth pad for removably receiving the interior heating pad therein. Coupling means are provided and are adapted for coupling the heating element to the bottle. The coupling means is comprised of a first hook and loop patch disposed on a first side of the outer cloth pad inwardly of a first end thereof and a second hook and loop patch disposed on a second side of the outer cloth pad inwardly of a second end thereof. The first and second hook and loop patches mate with one another when the heating element is wrapped around the bottle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved removable cloth sleeve with incorporated heating coil which has all the advantages of the prior art heating devices and none of the disadvantages.

It is another object of the present invention to provide a new and improved removable cloth sleeve with incorporated heating coil which may be easily and efficiently manufactured and marketed.

It is a further object of the present invention to provide a new and improved removable cloth sleeve with incorporated heating coil which is of durable and reliable construction.

It is yet a further object of the invention to provide a new and improved heating device which is safe to use around the bathroom. Accordingly, the entire heating coil is encased in an electrically insulative protective layer.

An even further object of the present invention is to provide a new and improved removable cloth sleeve with incorporated heating coil which is susceptible of a low cost of manufacture with regard to both materials and labor, and which accordingly is then susceptible of low prices of sale to the consuming public, thereby making such a removable cloth sleeve with incorporated heating coil economically available to the buying public.

Even still another object of the present invention is to provide a new and improved removable cloth sleeve with incorporated heating coil for allowing any standard lotion bottle to be warmed before application.

Lastly, it is an object of the present invention to provide a new and improved removable cloth sleeve with incorporated heating coil including a heating element wrappedly engaging the bottle of lotion. The heating element is comprised of an interior heating pad. The interior heating pad has an innermost heating coil. The heating element includes an outer cloth pad for removably receiving the interior heating pad therein. Coupling means are provided and are adapted for coupling the heating element to the bottle of lotion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the removable cloth sleeve with incorporated heating coil constructed in accordance with the principles of the present invention.

FIG. 2 is a plan view of the heating element of the present invention.

The same reference numerals refer to the same parts through the various figures.

DESCRIPTION OF THE PREFERRED EMBODIMENT

Figure 3:
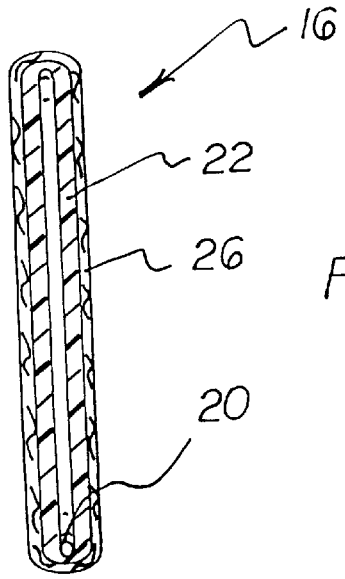
FIG. 3 is a cross-sectional view of the present invention as taken along line 3—3 of FIG. 2.
Figure 4:
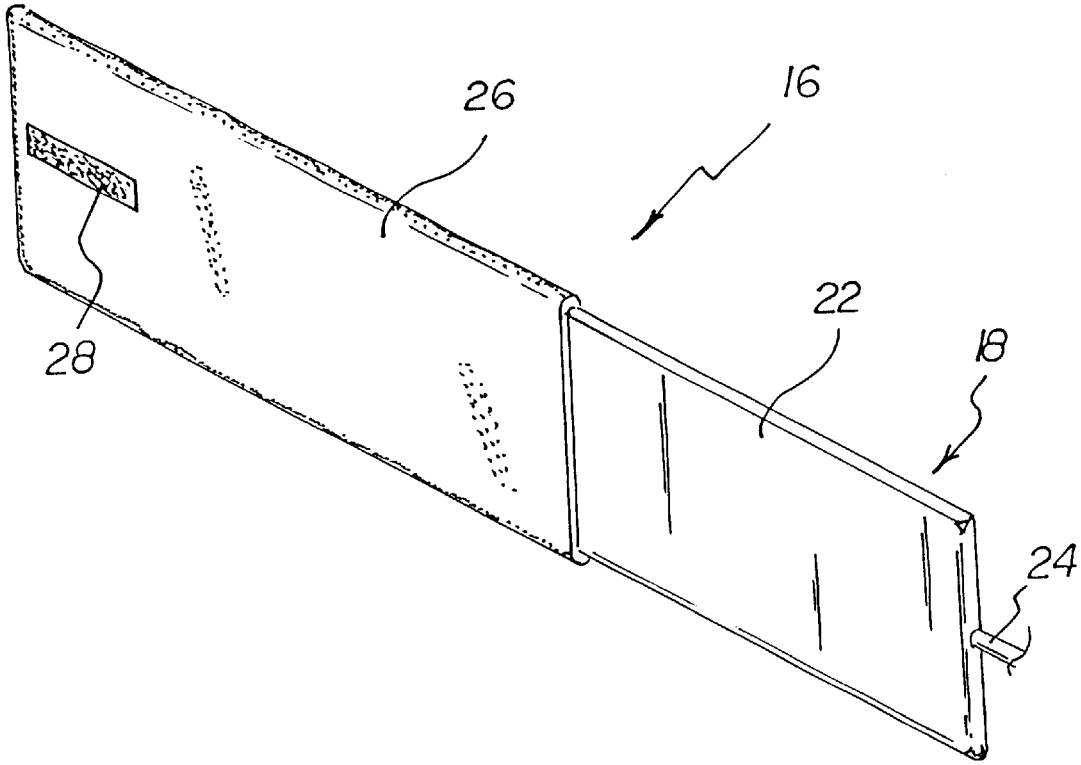
FIG. 4 is a perspective view of the present invention illustrating the heating pad removed from the cloth cover.

With reference now to the drawings, and in particular, to FIGS. 1 through 4 thereof, the preferred embodiment of the new and improved removable cloth sleeve with incorporated heating coil embodying the principles and concepts of the present invention and generally designated by the reference number 10 will be described.

Specifically, it will be noted in the various Figures that the device relates to a removable cloth sleeve with incorporated heating coil for allowing lotion to be warmed before application. In its broadest context, the device consists of a heating element and coupling means. Such components are individually configured and correlated with respect to each other so as to attain the desired objective.

The heating element 16 is adapted for wrappedly engaging a bottle portion. Note FIG. 1. The heating pad 16 will be able to wrap around any standard lotion bottle having an openable top 14 for dispensing lotion. The heating pad 16 may also be engaged to lotion tubes and "flat type" lotion bottles. The bottle 12 illustrated in FIG. 1 is therefore merely illustrative of the type that can be utilized. The heating element 16 is comprised of an interior heating pad 18. The interior heating pad 18 has an innermost heating coil 20 arranged in a serpentine configuration. This configuration is preferred because it distributes the heat through the entire heating element 16. The innermost heating coil 20 is disposed within an electrically insulative protective liner 22. The protective liner 22 will protect a user against burns while at the same time protecting the innermost heating coil 20 from wetness, and therefore protect the user from electrical shocks therefrom. The interior heating pad 18 has a power cord 24 connected the the innermost heating coil 20, for operatively coupling with an electrical outlet 25. The heating element 16 includes an outer cloth pad 26 for removably receiving the interior heating pad 18 therein. Thus, the outer cloth pad 26 can be removed to allow for proper cleaning when necessary. In addition, the power cord 24 extends directly outward from the outer cloth pad 26. Thus, the heating element 16 is a stand-alone unit which attaches directly onto the lotion bottle, and connects directly therefrom to a power outlet.

The coupling means are adapted for coupling the heating element 16 to the bottle 12. The coupling means is comprised of a first hook and loop patch 28 disposed on a first side of the outer cloth pad 26 inwardly of a first end thereof and a second hook and loop patch 30 disposed on a second side of the outer cloth pad inwardly of a second end thereof. The first and second hook and loop patches 28,30 mate with one another when the heating element 16 is wrapped around the bottle 12. Note FIG. 1. Other means for coupling could also be utilized, although the use of hook and loop material is preferred.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A stand-alone removable cloth sleeve with incorporated heating coil for allowing lotion to be warmed before application comprising, in combination:

a heating element adapted for wrappedly engaging a bottle of lotion, the heating element being comprised of an outer cloth and an interior heating pad, the interior heating pad removably located within the outer cloth, the interior heating pad having an innermost heating coil in a serpentine configuration, the innermost heating coil being disposed within an electrically insulative protective liner;

a power cord directly connected to the innermost heating coil, and extending directly outwardly from the outer cloth; and coupling means adapted for coupling the heating element to a bottle of lotion, the coupling means being comprised of a first hook and loop patch disposed on a first side of the outer cloth pad inwardly of a first end thereof and a second hook and loop patch disposed on a second side of the outer cloth pad inwardly of a second end thereof, the first and second hook and loop patches mating with one another when the heating element is wrapped around a bottle of lotion.

2. A stand-alone removable cloth sleeve with incorporated heating coil for allowing lotion to be warmed before application comprising, in combination:

a heating element adapted for wrappedly engaging a bottle of lotion, the heating element being comprised of an interior heating pad, the interior heating pad having an innermost heating coil, the heating element including an outer cloth pad removably receiving the interior heating pad therein;

a power cord directly connected to the innermost heating coil, extending directly outwardly from the outer cloth; and coupling means adapted for coupling the heating element to the bottle of lotion.

3. The removable cloth sleeve with incorporated heating coil as set forth in claim 2 wherein the innermost heating coil is in a serpentine configuration.

4. The removable cloth sleeve with incorporated heating coil as set forth in claim 2 wherein the innermost heating pad is disposed within a protective liner.

5. The removable cloth sleeve with incorporated heating coil as set forth in claim 2 wherein the coupling means is comprised of a first hook and loop patch disposed on a first side of the outer cloth pad inwardly of a first end thereof and a second hook and loop patch disposed on a second side of the outer cloth pad inwardly of a second end thereof, the first and second hook and loop patches mating with one another when the heating element is wrapped around the bottle portion.

* * * * *